United States Patent [19]

Aida

[11] Patent Number: 5,033,895

[45] Date of Patent: Jul. 23, 1991

[54] WRITING-UTENSIL PACKING KIT ASSEMBLY

[75] Inventor: Masaaki Aida, Tokyo, Japan

[73] Assignee: Midori Co., Ltd., Sumida, Japan

[21] Appl. No.: 282,468

[22] Filed: Dec. 9, 1988

[30] Foreign Application Priority Data

Dec. 17, 1987 [JP] Japan ..... 62-191789

[51] Int. Cl.[5] ..... B43K 31/00

[52] U.S. Cl. ..... 401/131; 24/3 F; 24/10 R; 24/11 R; 24/11 CT; 206/371; 211/69.5; 401/243; 401/195

[58] Field of Search ..... 24/11 R, 11 CT, 11 EE, 24/3 F, 3 G, 3 H, 3 L, 10 R; 401/202, 243, 244, 245, 246, 247, 131, 195; 206/37, 371; 211/69.1, 69.5

[56] References Cited

U.S. PATENT DOCUMENTS

| | | | |
|---|---|---|---|
| 1,711,970 | 5/1929 | Salz | 266/37 X |
| 1,921,270 | 8/1933 | Talt | 24/11 CT |
| 2,472,344 | 6/1949 | Rosenbarger | 24/3 F |
| 2,916,013 | 12/1959 | Rhoades et al. | 401/247 |
| 4,368,746 | 1/1983 | Spatz | 401/202 |

FOREIGN PATENT DOCUMENTS

| | | | |
|---|---|---|---|
| 2356981 | 5/1974 | Fed. Rep. of Germany | 401/245 |
| 22059 | of 1914 | United Kingdom | 24/10 R |

*Primary Examiner*—Steven A. Bratlie
*Attorney, Agent, or Firm*—Morrison Law Firm

[57] ABSTRACT

A writing instrument packing kit assembly comprises a body and a lid member joined together so as to be detachable. The body is provided in its bottom with a holder portion adapted to assure that the tips of writing instruments packed therein are clamped and held in place and around an open end with an inclined surface portion inclined slightly, gradually and outwardly from the open end and a recessed portion in the vicinity thereof, and the lid member is provided on the inner-peripheral side in the vicinity of its open end with a suitable number of projecting pieces to be inserted into the recessed portion in the body and on its inner periphery with a thickened portion to be joined to the inclined surface portion of the body.

1 Claim, 1 Drawing Sheet

WRITING-UTENSIL PACKING KIT ASSEMBLY

BACKGROUND OF THE INVENTION

This invention relates to a novel kit assembly for easily packing writing instruments therein, particularly instruments of small size.

Heretofore, there have been available various types of writing-instrument packing kits. However, such existing writing-instrument packing kits have generally been broken down into one type of a complicated structure and the other type of a simplified structure. A problem with the former type is that it is costly, whereas, a problem with the latter type is that the lid tends to open inadvertantly during use.

SUMMARY OF THE INVENTION

In view of the aforesaid problems, an object of this invention is to provide a writing-instrument packing kit assembly which is of simplified structure, convenient to handle and inexpensive to produce.

According to this invention, said object is achieved by the provision of writing-instrument packing kit assembly comprising a body and a lid member detachably joined together said body being provided at a bottom port with a holder portion adapted to assure that the tips of writing utensils packed therein are clamped and held in place and around a body open end there is an inclined surface portion on that body end which inclines gradually and outwardly from said open end. Also there is a recessed portion in the body adjacent the inclined surface portion. The lid member is provided on an inner-peripheral side thereof in the vicinity of an open end thereof, with a suitable number of projecting pieces to be inserted into said recessed portion in said body there also being at said periphery a thickened portion, which engages said inclined surface portion of said body when the lid is fitted to the body.

According to the invention, the tips of the writing instruments are held in place with holder portion formed on the bottom of the body. At the same time, when the lid member is put on the body, the inclined surface portion of the body is joined to the thickened portion of the lid member, and the projecting pieces of the lid member are received in the body recessed portion.

BRIEF DESCRIPTION OF THE DRAWINGS

One writing-instrument packing kit assembly of this invention will now be described, by way of example, with reference to the accompanying drawing, in which.

DETAILED DESCRIPTION

Figure 1:
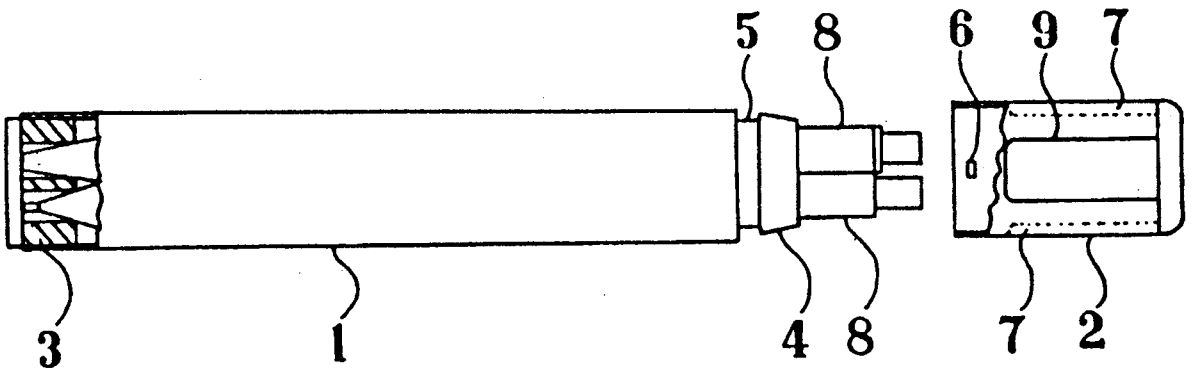
FIG. 1 is a front view of one embodiment of this invention, the lid being shown separated from the body.

The writing-instruments packing kit assembly according to the present invention comprises a body 1 joined to a lid member 2 so as to be detachable. In its bottom the body 1 is provided with a holder portion 3 adapted to assure that the tips of writing-instruments 8 are clamped and held in place. Around an open end of the body 1, there are formed an inclined tapered surface portion 4 which is inclined slightly and gradually outwardly from the open end and a recessed portion 5 adjacent the external portion.

The lid member 2 is provided with a suitable number of projecting pieces 6 on its inner-peripheral side in the vicinity of its open end and a slightly thickened portion 7 on its inner periphery. In FIG. 1, reference numeral 9 designates a clip 7.

While this invention has been described, specifically but not exclusively, with reference to one embodiment, various modifications and changes may be made within the purport as defined in the appended claims. For instance, it is more advantageous that the holder portion 3 provided in the bottom of the body 1 is formed of a rubber material of suitable contraction and expansion properties, etc.

According to the kit assembly according to this invention, the tips of the writing instruments packed therein are clamped in place with the holder portion 3 formed on the bottom of the body 1. At the same time, when the lid member 2 is put on the body 1, the inclined surface portion 4 of the body 1 is firmly joined to the thickened portion 7 of the lid member 2, and the projecting pieces 6 of the lid member 2 are inserted into the recessed portion 5. For all the simplified structure, therefore, the writing instruments 8 packed therein are securely held within the body 1, and the lid member 2 is firmly receivable on the body 1.

It is to be understood that if the holder portion 3 to be provided on the bottom of the body 1 is formed of a rubber or like materials, then the tips of the writing utensils are more firmly clamped in place on account of its contraction and expansion properties.

What is claimed is:

1. A writing instrument kit assembly comprising, a body, a lid member removably attachable on said body, and a plurality of writing instruments, said body being provided at a bottom end thereof with a holder having a corresponding plurality of holder portions for receiving and holding tip ends of the respective writing instruments, said writing instruments extending outwardly of said body at an opposite open end in said body, said body having a section thereof extending from the body open end in the direction of the bottom end which includes a tapered part and a recessed part adjacent the tapered part, said lid when received on the body covering the instruments where same extend outwardly of the body, an inner surface of the lid including projections which are receivable in the recessed part of the body, and said tapered body part being engaged by interior thickened parts of said lid whereby said lid is held securely attached to said body.

* * * * *